United States Patent [19]

Walling et al.

[11] 4,164,245

[45] Aug. 14, 1979

[54] POWDER PUSHING DEVICE FOR FILLING CABLE

[75] Inventors: Jorg-Hein Walling, St. Hubert; Jean Bouffard, Lachine, both of Canada

[73] Assignee: Northern Telecom Limited, Montreal, Canada

[21] Appl. No.: 876,875

[22] Filed: Feb. 13, 1978

[51] Int. Cl.[2] ..... B65B 37/10

[52] U.S. Cl. ..... 141/250; 174/102 P; 57/7

[58] Field of Search ..... 141/250, 290; 174/23 R, 174/23 C, 102 P, 118; 156/48; 57/8, 7; 222/413, 252, 410, 202, 195; 366/155, 156, 325

[56] References Cited

U.S. PATENT DOCUMENTS

| | | | |
|---|---|---|---|
| 1,127,281 | 2/1915 | Read | 174/102 P |
| 2,226,590 | 12/1940 | Smyers | 57/7 |
| 2,316,814 | 4/1943 | Schemm | 222/195 X |
| 2,988,249 | 6/1961 | Wahl | 222/413 |
| 3,538,235 | 11/1970 | Arendt et al. | 174/23 C |
| 3,693,839 | 9/1972 | Shaver et al. | 222/195 |

*Primary Examiner*—Willis Little

[57] ABSTRACT

A device for filling the interstices of multi-stranded cable with powder, comprising an outer cylindrical housing and a concentric inner tube with a closed annular chamber between them. A hopper opens into the chamber and the chamber opens into the tube. A feeder in the chamber pushes the powder from the opening of the hopper to the opening into the tube.

10 Claims, 4 Drawing Figures

FIG. 2
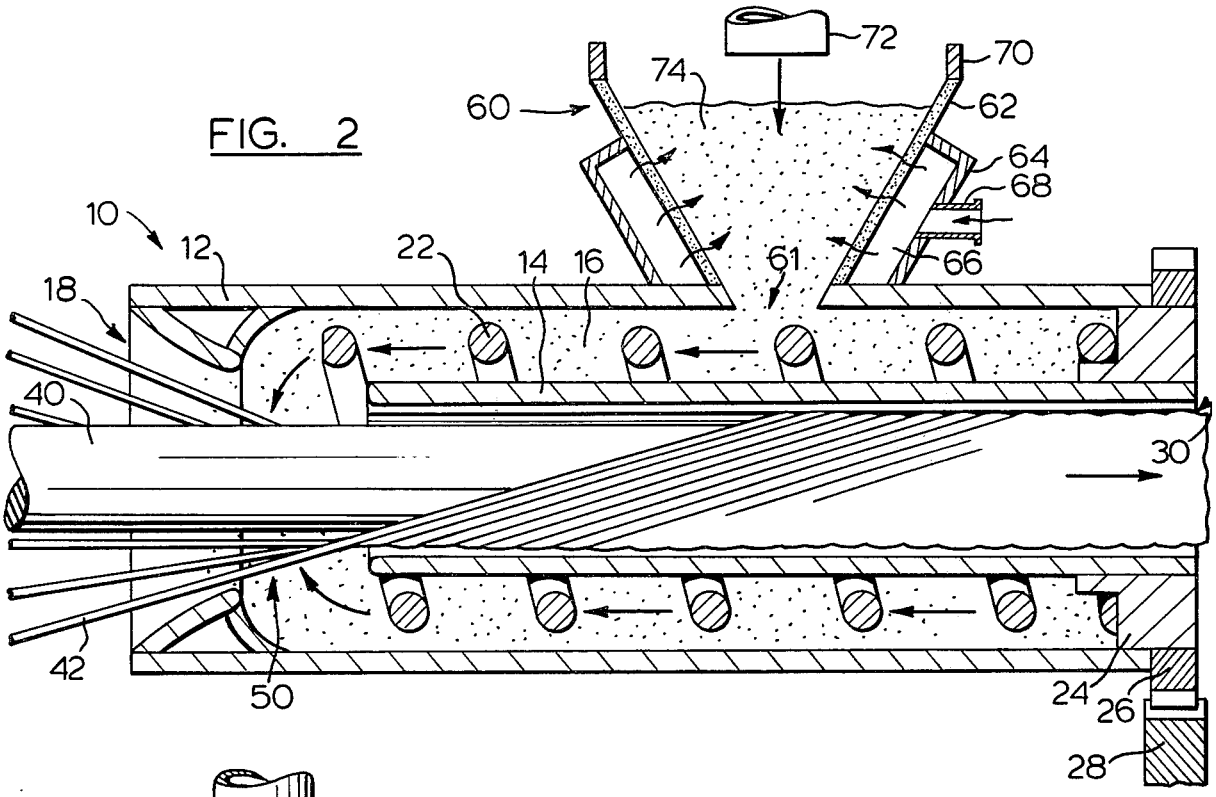
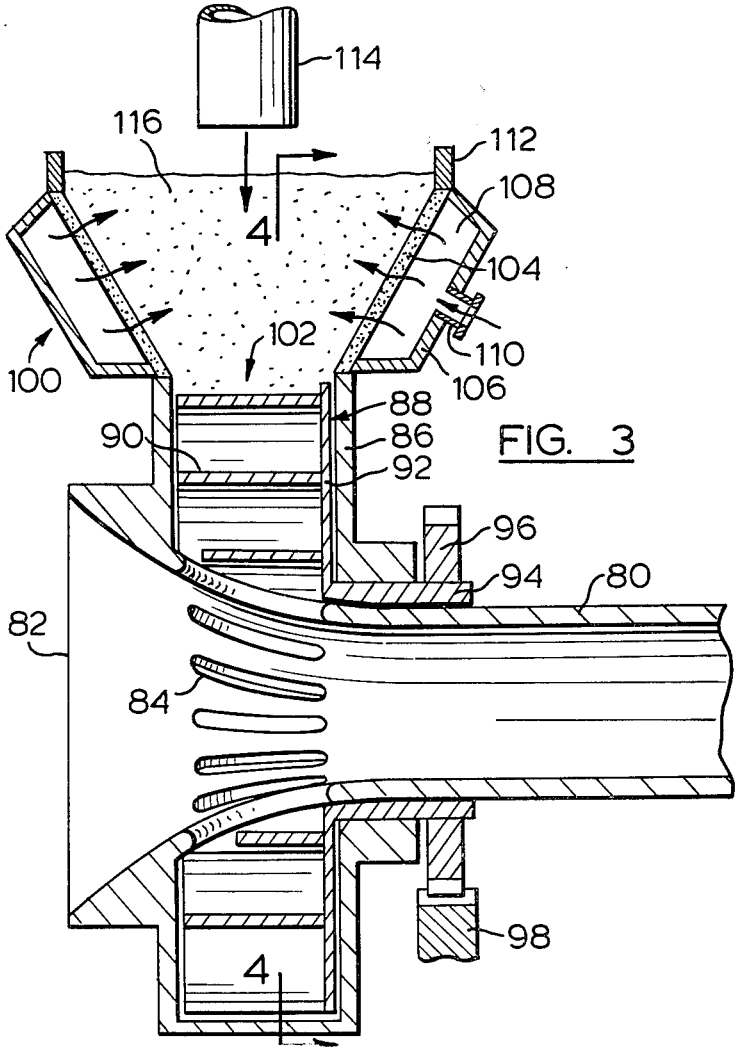
FIG. 3
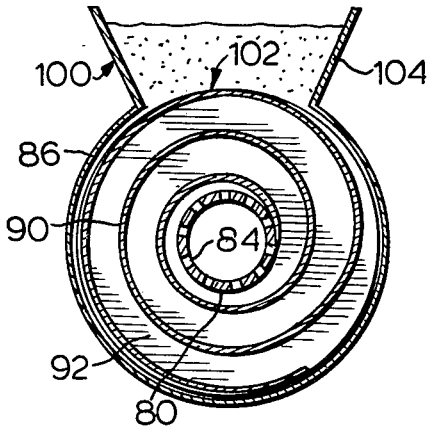
FIG. 4

POWDER PUSHING DEVICE FOR FILLING CABLE

This invention relates to the production of multi-stranded electrical cables and more particularly to filling the interstices of such cables with powder.

Multi-stranded electrical cables are filled with powder for water blockage. A powder filling for this purpose is described in U.S. Pat. No. 4,002,819 issued Jan. 11, 1977 to Northern Telecom Limited assignee of Leo. V. Woytiuk. One method of filling the interstices of the cable is by passing the cable core through an electrostatic powder chamber as described in United States patent application Ser. No. 564,070 filed Apr. 1, 1975 in the name of Leo V. Woytiuk assignor to Northern Telecom Limited. Such a method is relatively difficult to operate to obtain fine adjustments in the amount of powder filling placed within the interstices of the cable, i.e. the percentage of voids filled by the powder.

It is an object of the present invention to provide an improved method and apparatus for powder filling a multi-stranded cable.

Essentially the invention consists of a device for filling the interstices of multi-stranded cable with powder, comprising: a cylindrical housing, a tube concentric with the housing and spaced inwardly therefrom to form an annular chamber, the tube flaring outwardly at the inlet end thereof, the chamber being closed at each end thereof and opening annularly into the tube adjacent said inlet end; powder feeding means opening into the housing; and means to move powder from the hopper opening to the annular opening and therethrough into the tube.

Example embodiments of the invention are shown in the accompanying drawings in which:

FIG. 2 is a view similar to FIG. 1 showing one alternate embodiment of the device;

FIG. 3 is a view similar to FIG. 1, with the cable omitted, showing another alternate embodiment of the device; and FIG. 4 is a cross-sectional view taken along line 4—4 of FIG. 3.

Figure 1:
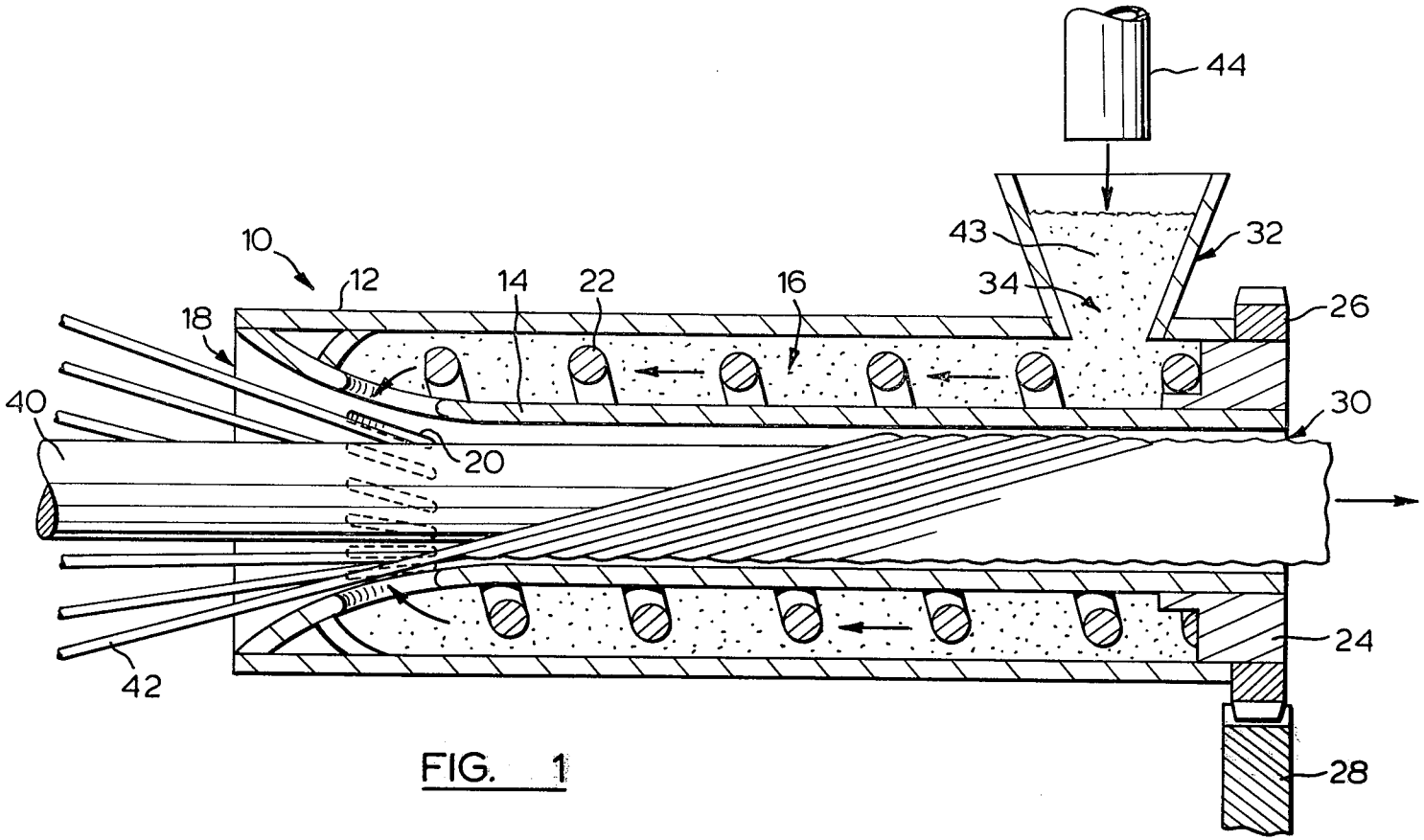
FIG. 1 is a side view in cross-section of a device for powder filling a cable.

The example embodiment shown in FIG. 1 of the drawings consists of a cable filling device 10 having a cylindrical housing 12 and a coaxial tube 14 spaced inwardly from the housing to provide an annular chamber 16. Tube 14 flares outwardly adjacent its inlet end 18 to meet the end of housing 12 and to close one end of chamber 16. A circumferential row of parallel, spaced slots 20 is located in tube 14 adjacent inlet end 18.

A helical screw member 22 is located in chamber 16 with one end terminating adjacent slots 20. The end of screw 22 remote from slots 20 is fixed to an annular hub 24 of a gear 26 which is coaxial with housing 12 and tube 14. Gear 26 meshes with a drive gear 28. Hub 24 closes chamber 16 at the outlet end 30 of tube 14 and the hub is freely rotatable axially on the tube. Powder feeding means in the form of a hopper 32 is mounted on housing 12 and opens laterally into chamber 16 adjacent hub 24 through an aperture 34 in the housing.

In the operation of the example embodiment shown in FIG. 1 a core 40 is continuously fed axially through tube 14 from inlet end 18 to outlet end 30 of the tube. At the same time a number of conductors 42 are fed into inlet end 18 of tube 14, for example from a multi-cage strander, and spirally wound on core 40. A powder mixture 43 of predetermined blend is passed in a continuous flow, or as needed, into hopper 32 from an inlet conduit 44. The powder from hopper 32 passes through aperture 34 in housing 12 into chamber 16 and is carried forward in the chamber by the axial rotation of helical screw 22 which is driven by gear 28 through gear 26. As the powder mixture reaches the end portion of chamber 16 adjacent inlet end 18 of tube 14 it passes through slots 20 in the tube and onto core 40. The lateral movement of conductors 42 as they are wound about core 40 assists in the movement of the powder against the core.

The amount of powder applied to core 40 is governed by the speed of travel of the core, the size slots 20, the speed of axial rotation of helical screw 22 and the pitch of the screw. The application of the powder to core 40 is aided by sloping slots 22 with respect to the axial plane of tube 14 and in the direction of the slope of conductors 42 as seen in FIG. 1.

In the alternate example embodiment of the device shown in FIG. 2 of the drawings slots 20 in tube 14 of the previous example embodiment are replaced by an annular opening 50 which allows greater access of powder from chamber 16 onto core 40 (tube 14 would be suitably supported by bars not shown). Also, hopper 32 of the previous embodiment is modified to provide a fluidized bed of powder. In the embodiment of FIG. 2 a hopper 60, opening onto housing 12 through an aperture 61, has a porous side wall 62 circumscribed by an annular housing 64 forming a plenum chamber 66 with an air inlet 68. Side wall 62 is connected with a vibrator indicated schematically by numeral 70.

In the operation of the embodiment of FIG. 2 powder flows into hopper 60 from a conduit 72, either continuously or intermittently as required to keep the hopper filled. Air is introduced under pressure through inlet 68 and passes from plenum chamber 66 through porous wall 62 into hopper 60. At the same time hopper 60 is oscillated by vibrator 70 and powder within the hopper forms a fluidized bed 74. This activated state of the powder mixture facilitates its movement through chamber 16 and onto core 40.

In FIGS. 3 and 4 the further alternate embodiment consists of a tube 80 flaring outwardly at its inlet end 82 with a circumferential row of parallel, spaced slots 84 located in the wall of the tube adjacent its inlet end. A circular housing 86 circumscribing tube 80 adjacent inlet end 82 defines a chamber 88 which contains a spiral feeder 90 fixed on an end plate 92 having a collar 94 projecting outside the housing and carrying an annular gear 96 engagable with a drive gear 98. A hopper 100 opens through an aperture 102 in housing 86 into chamber 88. As in the previous embodiment, hopper 100 has a porous side wall 104 circumscribed by an annular housing 106 forming a plenum chamber 108 with an inlet 110. Side wall 104 is connected with a vibrator 112.

In the operation of the embodiment shown in FIGS. 3 and 4 powder is introduced into hopper 100 through a conduit 114 as required to keep the hopper filled. Vibrator 112 oscillates hopper 100 and air under pressure enters through porous wall 104 to form a fluidized bed 116 of powder in the hopper. As a core passes into tube 80 through inlet 82 together with a plurality of strands to wrap the core, spiral feeder 90 is rotated by gear 98. To clarify the structure of FIGS. 3 and 4 the core and strands have been omitted but they pass through tube 80 in the same manner as in the previously described embodiments. Powder from hopper 100 passing though aperture 102 of housing 86 into chamber 88 is picked up by feeder 90 and moved towards slots 84 as the spiral feeder rotates, finally being forced through slots 84 onto the core within tube 80.

It will be appreciated that the core and strands shown in FIGS. 1 and 2 of the drawings are only illustrative and other types of multi-stranded cable may be powder filled by the device of the invention.

It will also be appreciated that types of mechanisms for driving helical screw 22 may be employed other than meshing gears 26 and 28; for example a worm gear and screw, a belt and pulley, or a chain and sprocket may be used.

I claim:

1. A device for filling the interstices of multi-stranded cable with powder, comprising:

a cylindrical housing;

a tube within the housing for receiving the multistranded cable, the tube being concentric with the housing and spaced inwardly therefrom to form an annular chamber between said housing and tube, the tube further being flared outwardly at the inlet end thereof, and having openings annularly disposed therein adjacent said inlet end, the chamber being closed at each end thereof and opening annularly into the tube via said slots;

powder feeding means opening into the housing; and means intermediate the housing and tube to move powder from the powder feeding means through the chamber and into the tube through said openings, to the interstices of the multistranded cable.

2. A device as claimed in claim 1 in which the powder feeding means comprises a hopper.

3. A device as claimed in claim 1 in which the hopper includes vibrator means on air inflow means to form a fluidized bed of powder therein.

4. A device as claimed in claim 1 in which the means to move the powder comprises a helical screw member concentrically mounted within the chamber, and means to rotate the screw member axially.

5. A device as claimed in claim 4 in which the means to rotate the screw member comprises a hub having one end of the screw member fixed thereto, the hub projecting from the housing, and a gear fixed to the hub outside the housing.

6. A device as claimed in claim 5 in which the outwardly flaring tube meets the housing to close one end of the chamber and the hub closes the other end of the chamber.

7. A device as claimed in claim 1 in which the means to move the powder comprises a spiral feeder concentrically mounted in the housing, and means to rotate the spiral feeder axially.

8. A device as claimed in claim 7 in which the means to rotate the spiral feeder comprises a hub having the spiral feeder fixed thereto, the hub projecting from the housing, and a gear fixed to the housing outside the hub.

9. A device as claimed in claim 1 in which the chamber opens into the tube through an annular ring of spaced slots.

10. A device as claimed in claim 9 in which the slots are straight and positioned at an angle to the axial plane of the tube.

* * * * *